US010066633B2

(12) United States Patent
Wunderer

(10) Patent No.: US 10,066,633 B2
(45) Date of Patent: Sep. 4, 2018

(54) GAS TURBINE COMPRESSOR BLEED CHANNEL

(71) Applicant: MTU Aero Engines AG, Munich (DE)

(72) Inventor: Roland Wunderer, Unterschleissheim (DE)

(73) Assignee: MTU Aero Engines AG, Munchen (DE)

( * ) Notice: Subject to any disclaimer, the term of this patent is extended or adjusted under 35 U.S.C. 154(b) by 298 days.

(21) Appl. No.: 14/533,832

(22) Filed: Nov. 5, 2014

(65) Prior Publication Data

US 2015/0132115 A1 May 14, 2015

(30) Foreign Application Priority Data

Nov. 12, 2013 (EP) ..... 13192464

(51) Int. Cl.

| | |
|---|---|
| ***F04D 27/02*** | (2006.01) |
| ***F04D 29/54*** | (2006.01) |
| ***F04D 19/00*** | (2006.01) |

(52) U.S. Cl.

CPC ..... *F04D 27/023* (2013.01); *F04D 19/00* (2013.01); *F04D 29/541* (2013.01); *F04D 29/542* (2013.01); *F04D 29/547* (2013.01)

(58) Field of Classification Search

CPC ..... F04D 27/023; F04D 19/00; F04D 29/541; F04D 29/542; F04D 29/547; F04D 25/14; F04D 25/24; F04D 25/32

See application file for complete search history.

(56) References Cited

U.S. PATENT DOCUMENTS

| | | | | |
|---|---|---|---|---|
| 5,155,993 | A | 10/1992 | Baughman et al. | |
| 6,109,868 | A * | 8/2000 | Bulman | F01D 17/105 415/144 |
| 6,726,445 | B2 * | 4/2004 | Tsuchiya | F01D 5/10 415/119 |
| 7,249,929 | B2 * | 7/2007 | Cummings | F01D 17/105 29/889.22 |
| 8,220,276 | B2 * | 7/2012 | Clemen | F02C 6/08 415/144 |
| 2004/0033133 | A1 | 2/2004 | Muny | |
| 2009/0263233 | A1 | 10/2009 | Guemmer | |
| 2009/0301102 | A1 | 12/2009 | Clemen et al. | |
| 2013/0280046 | A1 | 10/2013 | Morel et al. | |

FOREIGN PATENT DOCUMENTS

| | | |
|---|---|---|
| DE | 40 38 353 A1 | 10/1991 |
| DE | 199 40 020 | 6/2000 |
| DE | 10 2008 014957 | 9/2009 |
| EP | 2 110 559 | 10/2009 |
| FR | 2 970 302 | 7/2012 |
| GB | 2 192 229 | 1/1988 |
| GB | 2 388 875 | 11/2003 |

* cited by examiner

*Primary Examiner* — Richard Edgar
*Assistant Examiner* — John S Hunter
(74) *Attorney, Agent, or Firm* — Davidson, Davidson & Kappel, LLC

(57) ABSTRACT

A gas turbine compressor including a guide vane (1), a moving vane (2), in particular downstream, and a bleed channel (3) having an upstream channel wall (3.1), which merges into an annular space (5), an axially opposite downstream channel wall (3.2) having an inlet edge (3.3), which is rounded in particular, and a bleed channel outlet, the downstream channel wall enclosing with an axis of rotation of the compressor a first angle (α) which increases in the flow direction (x).

14 Claims, 2 Drawing Sheets

GAS TURBINE COMPRESSOR BLEED CHANNEL

This claims the benefit of European Patent Application EP 13 192 464.9, filed Nov. 12, 2013 and hereby incorporated by reference herein.

The present invention relates to a gas turbine compressor having a bleed channel and a gas turbine, in particular an aircraft engine gas turbine having such a gas turbine compressor.

BACKGROUND

DE 40 38 353 A1, DE 199 40 020 C2 and US 2004/0033133 A1, for example, describe bleed channels having straight downstream channel walls constantly inclined toward the axis of rotation of the compressor.

SUMMARY OF THE INVENTION

It is an object of the present invention to provide an improved gas turbine compressor.

The present invention provides a gas turbine compressor, in particular an aircraft engine gas turbine, including a guide vane having a plurality of guide blades distributed in the circumferential direction and a moving vane having a plurality of moving blades distributed in the circumferential direction.

In one embodiment, the guide vane is situated upstream from at least one additional outlet guide vane, in particular the last in the flow direction and/or upstream from a downstream moving vane. In one embodiment, one or multiple additional moving vanes and guide vanes may be situated between the guide vane and the outlet guide vane.

The guide vane and the moving vane are situated in an annular space, which is provided to have a working gas, in particular air, flowing through it during operation. A cross section of the annular space may converge in at least some sections or may at least be essentially constant.

One radially outer wall of the annular space merges into an upstream channel wall of a bleed channel. In one embodiment, the upstream channel wall merges steadily into the radially outer wall. Axially on the opposite side, the bleed channel has a downstream channel wall having a radially inner inlet edge. In one embodiment the radially inner inlet edge is offset radially toward the inside with respect to the transition of the upstream channel wall into the radially outer wall. On one end facing away from the annular space, the bleed channel has a bleed channel outlet.

The terms "upstream" and "downstream" refer to the normal flow direction during operation of the compressor, in particular an axial direction from the guide vane to the moving vane and/or from a compressor inlet to a compressor outlet.

The bleed channel may be an annular channel in one embodiment whose inlet edge extends by 360° in the circumferential direction. In one embodiment, the inlet edge is rounded or has a radius that is constant in particular. In another embodiment, the bleed channel has multiple chimneys spaced a distance apart from one another in the circumferential direction or passages separated from one another.

The bleed channel may communicate at its bleed channel outlet with an, in particular annular, plenum, in particular to convey gas bled off from the compressor during operation, for example, for component cooling or the like. In one embodiment, the bleed channel communicates with an inflow channel, which may in turn communicate with the plenum.

According to one aspect of the present invention, the downstream channel wall encloses with one axis of rotation of the compressor, an angle which increases in particular continuously, i.e., steadily in the flow direction, and is referred to hereinafter as the first angle. In one embodiment, the bled off flow may hereby be guided with less loss. Additionally or alternatively, losses in the main flow in the annular space downstream from the inlet edge may also be reduced hereby.

In one embodiment, the first angle beyond the inlet edge increases in the flow direction, in particular according to a radius of a rounded inlet edge. In one embodiment, the bleeding off of the flow at the bleed channel inlet may be improved hereby.

Additionally or alternatively, the first angle in one embodiment increases monotonically in the flow direction, in particular strictly monotonically. In the present case, this is understood in particular to mean that the first angle is at least as large at any arbitrary axial position as at any axial position situated upstream therefrom (monotonic) or the first angle at any arbitrary axial position is larger than at any axial position upstream therefrom (strictly monotonic). In other words, in one embodiment, the downstream channel wall is curved in some sections or over its entire length. In one embodiment, the downstream channel wall may have an essentially constant radius of curvature in some sections or over its entire length or may have an at least essentially constant curvature. In another embodiment, a curvature of the downstream channel wall may increase or decrease in some sections or over its entire length or its radius of curvature may increase or decrease. In one embodiment, the bled off flow may be guided hereby with a particularly low loss.

In one embodiment, the first angle at the bleed channel outlet is larger than 30°, in particular larger than 40°. Therefore the bled off flow may be implemented in one embodiment with low loss.

In one embodiment, the upstream channel wall also encloses with the axis of rotation an angle which increases in the flow direction; this angle is referred to below as the second angle.

In one embodiment, the second angle increases in the flow direction after the transition of the upstream channel wall into the radially outer wall of the annular space; in one refinement the upstream channel wall merges tangentially into the radially outer wall.

Additionally or alternatively, the second angle in one embodiment increases monotonically in the flow direction, in particular strictly monotonically. In other words the upstream channel wall is also curved in one embodiment in some sections or over its entire length. The upstream channel wall may have an at least essentially constant radius of curvature in one embodiment or an at least essentially constant curvature in some sections or over its entire length. In another embodiment, a curvature of the upstream channel wall may increase or decrease in some sections or over its entire length or its radius of curvature may increase or decrease.

If $\rho(x)$ denotes a radial coordinate of a channel wall, in particular its radially innermost extent and/or its radially innermost point at an axial position x, then in one embodiment, the channel wall encloses with the axis of rotation in this axial position x an angle $\varphi=\arctan(d\rho/dx)$. In other words, in one embodiment, the angle of a channel wall with the axis of rotation is understood to be the angle of a tangent to the channel wall with the axis of rotation.

In one embodiment, the second angle in the flow direction increases to a greater extent in some sections or over the entire length of the bleed channel between the inlet edge and the bleed channel outlet than the first angle. In particular the upstream channel wall may have a greater curvature in some sections or over its entire length than the downstream channel wall, so that in one embodiment, the bleed channel diverges in some sections or over its entire length.

In one embodiment, the bleed channel runs radially outward or away from the axis of rotation in some sections or over its entire length from the radially outer wall of the annular space. Accordingly, in one embodiment, the first and/or second angle, which increase(s) in the flow direction, is/are always greater than zero, as measured from the axis of rotation to the downstream or upstream channel wall. In one embodiment, if the radially outer wall of the annular space converges in the flow direction, the first and/or second angle(s) on the radially outer wall of the annular space may be negative and may become positive in the flow direction, in one refinement.

In one embodiment, the upstream channel wall merges from a trailing edge of the guide vane into the annular space downstream. In another embodiment, the upstream channel wall merges into the annular space upstream from a trailing edge of the guide vane. Additionally or alternatively, the trailing edge of the guide vane may be situated axially downstream or upstream from the inlet edge. In other words, in another embodiment, the bleed channel is situated partially in the guide vane or the trailing edge of the guide vane is situated axially inside the bleed channel.

According to one aspect of the present invention, a trailing edge of one or multiple, preferably all, the guide blades of the guide vane is inclined to a suction side of the guide blade over the entire blade height or annular space height or at least in a radially outer third, i.e., closer to the bleed channel, preferably a radially outer fifth or the radially outer 20% of a guide vane height or a guide blade height, in particular the radially outer 15% of the guide vane height in the circumferential direction. In one embodiment, the trailing edge is inclined to increase monotonically, in particular strictly monotonically, to the suction side. In other words, in one embodiment, the trailing edge is at least curved toward the suction side in the circumferential direction, at least in the radially outer 20%, in particular 15% of the guide vane height or the guide blade height. In one embodiment, this bending may take place by rotation of the complete guide blade profile or through a change in the blade curvature in the trailing edge area.

Additionally or alternatively, in one embodiment, the trailing edge may be offset over the entire blade height or at least in the radially outer third, preferably in the radially outer 20%, in particular 15% of the guide vane or guide blade height relative to a radially innermost trailing edge hub point of this outer area axially upstream or toward the inlet edge. In other words, the guide blade(s) may be shortened at least in one radially outer area or near the bleed channel.

Additionally or alternatively, in one embodiment, the trailing edge may enclose with the upstream channel wall an angle between 60° and 120°, in particular between 75° and 105°, measured in the axial direction or with respect to the projection in the meridional plane.

Due to one or multiple, preferably all, of the aforementioned features of the trailing edge(s) of the guide vane, in one embodiment, the bled off flow may be guided with an even lower loss. Additionally or alternatively, losses in the main flow in the annular space may thus be reduced even further downstream from the inlet edge.

In one embodiment, it holds that:

$$0.3\cdot(m_{Bleed}/m_{in})\cdot(R^2-r^2)/R\leq b_1, \quad (1)$$

in particular $$0.4\cdot(m_{Bleed}/m_{in})\cdot(R^2-r^2)/R\leq b_1, \quad (1')$$

and/or $$b1\leq 0.7\cdot(m_{Bleed}/m_{in})\cdot(R^2-r^2)/R, \quad (2)$$

in particular $$b1\leq 0.6\cdot(m_{Bleed}/m_{in})\cdot(R^2-r^2)/R \quad (2')$$

where:

a. $b_1$: channel height at the inlet edge, in particular the distance, or the shortest distance between the inlet edge and the upstream channel wall;

b. $m_{Bleed}$: mass flow in the bleed channel;

c. $m_{in}$: mass flow in the guide vane inlet;

d. R: outside radius of the annular space, in particular at the transition from the upstream channel wall to the radially outer wall of the annular space; and e. r: inside radius of the annular space, in particular at the transition of the upstream channel wall to the radially outer wall of the annular space.

Additionally or alternatively, in one embodiment it holds that:

$$b_1\leq r_K/5, \quad (3)$$

in particular $$b_1\leq r_K/4, \quad (3')$$

where:

a. $r_K$: radius of curvature of the upstream channel wall, in particular at the transition of the upstream channel wall to the radially outer wall of the annular space or at the inlet edge.

Additionally or alternatively, in one embodiment it holds that:

$$0.5\cdot[(r_K+b_1)_2-(r_K+H)^2]^{1/2}\leq L, \quad (4)$$

in particular $$0.9\cdot[(r_K+b_1)^2-(r_K+H)^2]^{1/2}\leq L, \quad (4')$$

and/or $$L\leq 1.5\cdot[(r_K+b_1)^2-(r_K+H)^2]^{1/2}, \quad (5)$$

in particular $$L\leq 1.1\cdot[(r_K+b_1)^2-(r_K+H)^2]^{1/2} \quad (5')$$

where:

a. H: radial distance between the inlet edge and the transition of the annular space into the upstream channel wall; and b. L: axial distance between the inlet edge and the transition of the annular space into the upstream channel wall; and c. $r_K$: local radius of curvature, in particular with $b_1$.

Additionally or alternatively, the following holds in one embodiment:

$$b_1\geq 0.5\cdot b_2, \quad (6)$$

in particular $$b_1 \geq 0.7 \cdot b_2, \quad (6')$$

where:

a. $b_2$: outlet channel height at the bleed channel outlet, in particular the distance or the shortest distance between the end of the upstream channel wall facing away from the annular space and the downstream channel wall.

Additionally or alternatively, it holds that in one embodiment:

$$(b_2 - b_1)/s \leq 0.2, \quad (7)$$

in particular $$(b_2 - b_1)/s \leq 0.14, \quad (7')$$

where:

a. s: length of the downstream channel wall between the inlet edge and the bleed channel outlet.

Each of the preceding equations (1) through (7') results separately, in particular in combination with one or multiple, in particular all, of the other equations, in a particularly advantageous bleed channel. In one embodiment, $b_1$ is initially determined according to at least one of equations (1) through (2'), and in a refinement thereof, additional variables, in particular $r_K$, H, L, $b_2$ and/or s, are derived according to one of the equations (3) through 7').

BRIEF DESCRIPTION OF THE DRAWINGS

Additional advantageous refinements of the present invention are derived from the subclaims and the following description of preferred embodiments.

DETAILED DESCRIPTION

Figure 1:
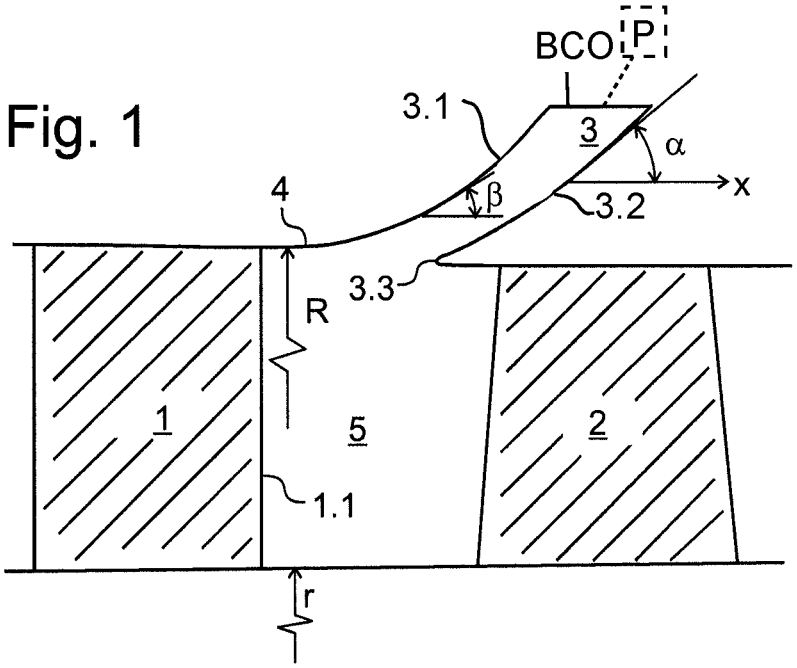
FIG. 1 shows partially schematically a part of a gas turbine compressor of an aircraft engine gas turbine in a meridional section according to one embodiment of the present invention.

FIG. 1 shows a part of a gas turbine compressor of an aircraft engine gas turbine in a meridional section according to one embodiment of the present invention. It has a guide vane having a plurality of guide blades 1 distributed in the circumferential direction and a moving vane having a plurality of moving blades 2 distributed in the circumferential direction.

The guide vane is situated upstream from the downstream moving vane and an additional outlet guide vane, in particular the last one in the flow direction x (not shown). One or multiple additional moving vanes and guide vanes may be situated between the guide vane shown here and the outlet guide vane (not shown).

The guide vane and the moving vane are situated in an annular space 5 which is provided so that air to be compressed flows through it during operation.

A radially outer wall (at the top in FIG. 1) of the annular space merges continuously or without a shoulder at a transition 4 into an upstream channel wall 3.1 of a bleed channel 3. Axially on the opposite side, the bleed channel has a downstream channel wall 3.2 having a radially inner, rounded inlet edge 3.3, offset radially toward the inside with respect to transition 4. Bleed channel 3 has a bleed channel outlet on an end facing away from the annular space (at the top in FIG. 1).

The bleed channel communicates with a plenum P at its bleed channel outlet BCO (shown schematically). Likewise, it may also communicate with an inflow channel, which may in turn communicate with the plenum.

Downstream channel wall 3.2 encloses with an axis of rotation of the compressor (horizontal line in FIG. 1) a first angle $\alpha$ which increases strictly monotonically in the flow direction x, starting at inlet edge 3.3, so in other words, the channel wall is curved over its entire length ($d\alpha/dx>0$).

Upstream channel wall 3.1 also encloses with the axis of rotation a second angle $\beta$ which increases strictly monotonically in the flow direction, starting at transition 4; in other words, this channel wall is also curved over its entire length ($d\beta/dx>0$), the upstream channel wall merging tangentially into the radially outer wall of annular space 5.

In the embodiment in FIG. 1, the upstream channel wall merges into the radially outer wall of annular space 5 downstream from (to the right of) trailing edges 1.1 of the guide blades of guide vane 1.

Figure 4:
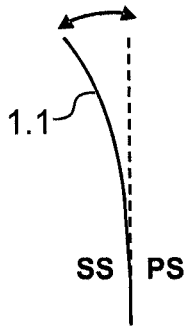
FIG. 4 shows partially schematically a view of a trailing edge of the guide vane of the gas turbine compressor or FIG. 1 in the direction opposite the flow direction.

FIG. 4 shows a view of a trailing edge 1.1 of a guide blade of guide vane 1 opposite the flow direction (i.e., from the right in FIG. 1).

As is apparent in particular, trailing edges 1.1 are inclined with a strict monotonic increase at least in the radially outer 20%, in particular 15%, of the guide vane height or guide blade height (R-r) (cf. FIG. 1) in the circumferential direction, from a pressure side PS to a suction side SS of the guide blade, in other words, having a curvature toward suction side SS.

Figure 3:
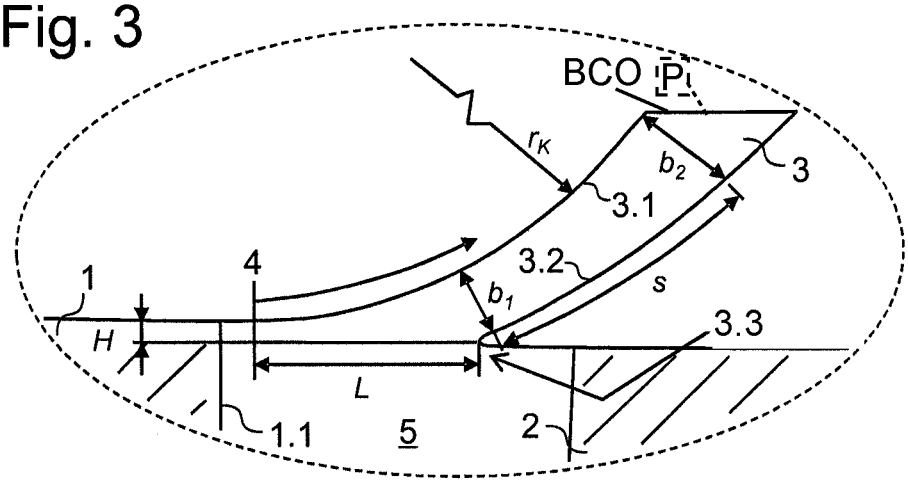
FIG. 3 shows partially schematically an enlarged detail of FIG. 1.

In an enlarged detail of FIG. 1, FIG. 3 shows in particular the bleed channel with a few variables, where $b_1$ denotes the channel height at inlet edge 3.3, in particular the distance, i.e., the shortest distance between inlet edge 3.3 and upstream channel wall 3.1, R and r denote the outside radius and inside radius, respectively, of the annular space at transition 4 from upstream channel wall 3.1 to the radially outer wall of annular space 5 (cf. FIG. 1), $r_K$ denotes the radius of curvature of upstream channel wall 3.1, H denotes the radial distance between inlet edge 3.3 and transition 4 of annular space 5 to upstream channel wall 3.1, L denotes the axial distance between inlet edge 3.3 and transition 4 of annular space 5 to upstream channel wall 3.1, $b_2$ denotes the outlet channel height at the bleed channel outlet, and s denotes the length of downstream channel wall 3.2 between inlet edge 3.3 and the bleed channel outlet.

Figure 2:
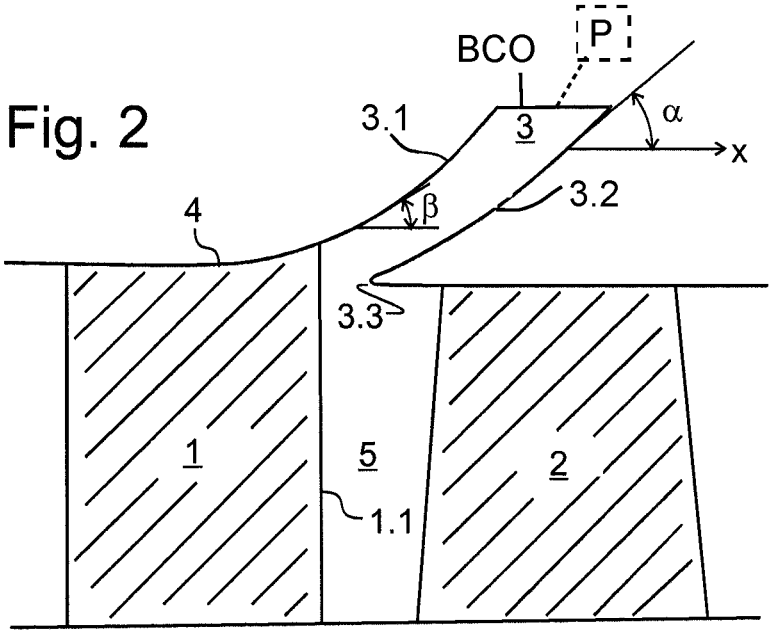
FIG. 2 shows partially schematically a part of a gas turbine compressor of an aircraft engine gas turbine in a meridional section according to another embodiment of the present invention.

FIG. 2 shows, in a manner corresponding to that in FIG. 1, a portion of a gas turbine compressor of an aircraft engine gas turbine according to one embodiment of the present invention. Corresponding features are labeled with identical reference numerals, so that reference is made to the description of the embodiment of FIG. 1 and only differences in comparison with this are discussed below.

In the embodiment according to FIG. 2, upstream channel wall 3.1 merges upstream (at the left) from trailing edge 1.1 of the guide vane into the radially outer wall of annular space 5, which is situated upstream axially from inlet edge 3.3. In other words, bleed channel 3 is partially situated in the guide vane in the embodiment according to FIG. 2.

Although the exemplary embodiments have been explained in the preceding description, it should be pointed out that many modifications are possible. In addition, it should be pointed out that the exemplary embodiments pertain only to examples that should in no way restrict the scope of protection, the applications or the design. Those skilled in the art are instead given a guideline for the implementation of at least one exemplary embodiment through the preceding description, but various changes may be made in particular with regard to the function and configuration of the components described here, without departing from the scope of protection, as derived from the claims and the combinations of features equivalent thereto

LIST OF REFERENCE NUMERALS

1 guide blade/vane
1.1 trailing edge
2 moving blade/vane
3 bleed channel
3.1 upstream channel wall
3.2 downstream channel wall
3.3 inlet edge
4 transition into the upstream channel wall
5 annular space

What is claimed is:

1. A gas turbine compressor comprising:

a guide vane;

a moving vane; and a bleed channel having a curved upstream channel wall merging into an annular space, a curved downstream channel wall downstream axially at a distance from the upstream channel wall and having an inlet edge, and a bleed channel outlet, the curved downstream channel wall defining, with respect to an axis of rotation of the compressor, a first angle increasing in the flow direction;

the curved upstream channel wall defining, with respect to the axis of rotation, a second angle increasing in the flow direction, the second angle increasing more than the first angle in the flow direction; and wherein:

$b_1 \leq r_K/5$; or $0.5 \cdot [(r_K+b_1)^2-(r_K+H)^2]^{1/2} \leq L \leq 1.2 \cdot [(r_K+b_1)^2-(r_K+H)^2]^{1/2}$ or $b_1 \geq 0.5 \cdot b_2$ or $(b_2-b_1)/s \leq 0.2$ with the inlet channel height $b_1$ at the inlet edge, the radius of curvature of the upstream channel wall $r_K$, the radial distance between the inlet edge and the transition of the annular space into the upstream channel wall H, the axial distance between the inlet edge and the transition of the annular space into the upstream channel wall L, the outlet channel height $b_2$ at the bleed channel outlet and the length of the downstream channel wall between the inlet edge and the bleed channel outlets.

2. The gas turbine compressor as recited in claim 1 wherein the first angle increases monotonically starting at the first inlet edge.

3. The gas turbine compressor as recited in claim 2 wherein the first angle increases strictly monotonically.

4. The gas turbine compressor as recited in claim 1 wherein the first angle at the bleed channel outlet is greater than 30°.

5. The gas turbine compressor as recited in claim 1 wherein the second angle increases monotonically.

6. The gas turbine compressor as recited in claim 1 wherein the curved upstream channel wall merges into the annular space upstream or downstream from a trailing edge of the guide vane.

7. The gas turbine compressor as recited in claim 1 wherein a trailing edge of at least one guide blade of the guide vane is inclined in the circumferential direction toward a suction side of the at least one guide blade in at least one radially outer third of a guide vane height or is offset axially upstream or defines, with respect to the curved upstream channel wall, an angle between 60° and 120°.

8. The gas turbine compressor as recited in claim 7 wherein the trailing edge of at least one guide blade of the guide vane is inclined in the circumferential direction toward a suction side of the at least one guide blade in at least one radially outer third of a guide vane height increasing monotonically.

9. The gas turbine compressor as recited in claim 1 wherein the moving vane is downstream of the guide blade.

10. The gas turbine compressor as recited in claim 9 wherein the inlet edge is rounded.

11. A gas turbine comprising a gas turbine compressor as recited in claim 1.

12. An aircraft engine gas turbine comprising a gas turbine compressor as recited in claim 1.

13. The gas turbine compressor as recited in claim 1 wherein an entire length of the curved upstream channel wall and an entire length of the curved downstream channel wall are curved.

14. The gas turbine compressor as recited in claim 1 wherein the curved downstream channel wall is curved from a rounded inlet edge to a bleed channel outlet.

* * * * *